US007586066B2

(12) United States Patent
Bell

(10) Patent No.: US 7,586,066 B2
(45) Date of Patent: Sep. 8, 2009

(54) HAIR STYLING DEVICE AND METHOD

(76) Inventor: Chris Baldwin Bell, P.O. Box 8441, Philadelphia, PA (US) 19101-8441

( * ) Notice: Subject to any disclaimer, the term of this patent is extended or adjusted under 35 U.S.C. 154(b) by 28 days.

(21) Appl. No.: 11/601,179

(22) Filed: Nov. 17, 2006

(65) Prior Publication Data

US 2007/0056960 A1 Mar. 15, 2007

Related U.S. Application Data

(63) Continuation-in-part of application No. 10/995,627, filed on Nov. 22, 2004, now abandoned.

(51) Int. Cl.
*H05B 6/64* (2006.01)
*A45D 24/10* (2006.01)
*A45D 5/06* (2006.01)

(52) U.S. Cl. ..... 219/678; 132/118; 34/283

(58) Field of Classification Search ..... 219/678, 219/690, 736, 737, 738; 34/282, 259, 260, 34/283, 95, 96, 101; 132/210, 211, 212, 132/216, 218, 223, 226, 230, 269, 270, 271
See application file for complete search history.

(56) References Cited

U.S. PATENT DOCUMENTS

| | | | | |
|---|---|---|---|---|
| 3,958,340 | A * | 5/1976 | Meyers | 34/259 |
| 5,299,367 | A * | 4/1994 | Johnson et al. | 34/95 |
| 5,325,600 | A * | 7/1994 | Gentile | 34/260 |
| 5,434,390 | A * | 7/1995 | McKee et al. | 219/681 |
| 6,941,675 | B2 * | 9/2005 | Slingo | 34/96 |

* cited by examiner

*Primary Examiner*—Daniel L Robinson
(74) *Attorney, Agent, or Firm*—Volpe and Koenig, PC.

(57) ABSTRACT

A hair styling apparatus including a magnetron and a styling base in communication with the magnetron for styling a moistened lock of hair is provided. A shield removably encases the styling base for shielding microwave radiation emitted from the magnetron. The lock of hair is heated upon activation of the magnetron. Methods of curling and straightening hair are also provided.

14 Claims, 15 Drawing Sheets

HAIR STYLING DEVICE AND METHOD

CROSS REFERENCE TO RELATED APPLICATION

This application is a continuation-in-part of U.S. patent application Ser. No. 10/995,627, filed Nov. 22, 2004, the entire contents of which is incorporated by reference as if fully set forth.

BACKGROUND

Conventional hair styling techniques can be tedious, expensive, and damaging to the hair. Many hair types require time-consuming multi-step processes such as blow drying, setting, relaxing, and the application of chemicals for a permanent style. The process of curling or straightening hair often requires the use of harsh chemicals. Such chemicals can burn a person's scalp or cause irritation or an allergic reaction. Styling chemicals can also damage hair or react poorly with color-treated hair or hair that has been chemically lightened.

Accordingly, there remains a need for an improved hair styling device and method that is quick, easy-to-use, and gentle on the hair and scalp.

There is further the need for an improved hair styling device and method that maintains a hair style for a significant period of time.

SUMMARY

The present invention provides a hair styling apparatus including a magnetron and a styling base in communication with the magnetron for styling moistened hair, such as a moistened lock or strands of hair. A shield removably encases the styling base for shielding microwave radiation emitted from the magnetron. The lock of hair is acted upon by microwaves upon activation of the magnetron.

The present invention also provides a method of curling hair. A lock of hair is wrapped around a styling base in communication with a magnetron, and a shield is clamped around the styling base. The magnetron is activated and then deactivated. The shield is then unclamped from the styling base and the lock of hair is unwrapped from the styling base.

The present invention further provides a method of straightening hair. A lock of hair is placed on a styling base in communication with a magnetron, and a shield is clamped against the styling base. The magnetron is activated and then deactivated. The shield is then unclamped from the styling base and the lock of hair is removed from the styling base.

DETAILED DESCRIPTION OF THE PREFERRED EMBODIMENTS

Figure 1A:
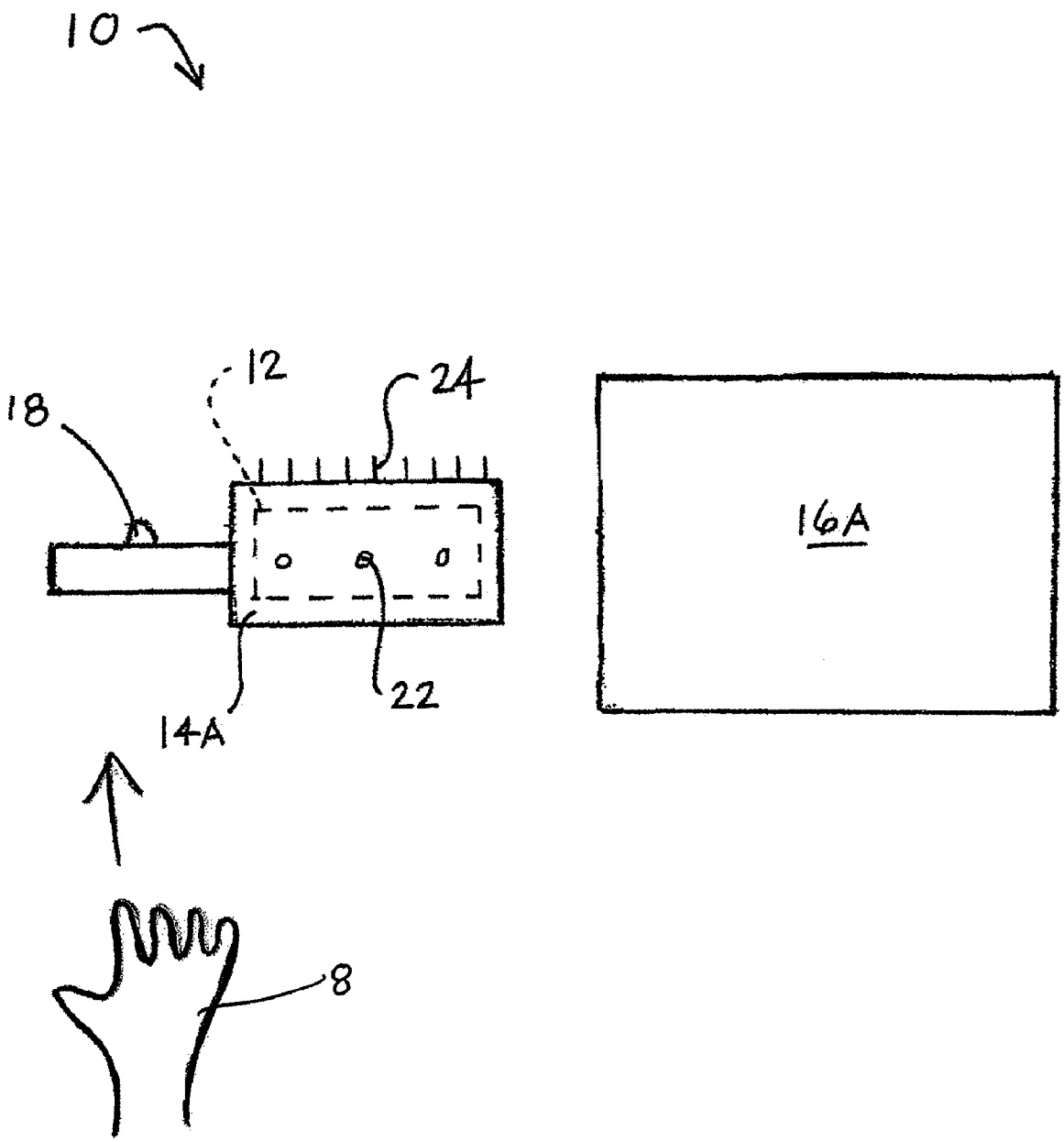
FIG. 1A is a schematic representation of a hair styling device showing a curling styling base, a magnetron disposed within the curling styling base, and a shield in accordance with the present invention.

Certain terminology is used in the following description for convenience only and is not considered limiting. Words such as "front," "back," "top," and "bottom" designate directions in the drawings to which reference is made. This terminology includes the words specifically noted above, derivatives thereof, and words of similar import. Additionally, the terms "a" and "one" are defined as including one or more of the referenced item unless specifically noted. The phrase "at least one of" followed by a list of two or more items, such as A, B, or C, means any individual one of A, B, or C, as well as any combination thereof.

The preferred embodiments of the present invention are described below with reference to the drawing figures where like numerals represent like elements throughout.

Referring generally to FIGS. 1A-5D, a hair styling device 10 includes a magnetron 12 and a styling base 14A-14C in communication with the magnetron 12 for styling a moistened lock of hair H. The term "magnetron" as used herein refers to a device for generating a magnetic field to produce microwaves, such as magnetrons used in microwave ovens, which are well known. A magnetron control circuit (which may include a microcontroller), and a waveguide 20 (which is well known) may also be incorporated as parts of the magnetron 12.

A shield 16A-16G removably encases the styling base 14A-14C for shielding microwave radiation emitted from the magnetron 12. The shield 16A-16G is preferably constructed from a combination of glass material and conductive mesh material. More specifically, the shield 16A-16G is preferably formed from a microwave shielding material adapted to deflect and/or block microwave radiation, such as shielding selected from a group which consists of a glass, ferrites, metals, or electrically conducting ceramic, or combinations thereof. The shield 16A-16G of the present invention, however, is not limited to these materials, and may comprise, for example, conductive plastic material, or any other material suitable for performing the microwave shielding function.

The lock of hair H is heated upon activation of the magnetron 12. A user may operate a switch 18 to activate and deactivate the magnetron 12. In the embodiments of the hair styling device 10 represented in FIGS. 1A, 1B, 1D-2B, and 4A-5D, the magnetron 12 may be disposed within a styling base 14A-14C. For the sake of clarity, such a configuration is represented specifically in FIGS. 1A, 1B, and 4C. A waveguide 20 may encase the magnetron 12 (as represented in FIG. 1B only, for clarity) to guide and direct the microwaves emitted from the magnetron 12, as desired. Alternatively, and as represented in FIG. 3, the magnetron 12 may be remotely connected to the styling base 14A-14C through a waveguide 20 that extends within the styling base 14A-14C. In another remote connection alternative, the magnetron 12 may be remotely connected to the styling base 14A-14C through an antenna (not shown) that extends within the styling base 14A-14C. It will be understood that, in either configuration (i.e., the magnetron 12 disposed within the styling base 14A-14C or remotely connected to the styling base 14A-14C), the waveguide 20 (or antenna) will guide and direct the microwaves emitted from the magnetron 12 through the styling base 14A-14C, as desired, based on the shape of the waveguide 20 (or transmission properties of the antenna) and through various patterns of apertures on its outer surface.

The styling base 14A-14C, shown in FIGS. 1A, 1B, 1D, 2A, 3, 4A, 4C, 5A, and 5C, may include a plurality of ventilation apertures 22 to allow steam generated during heating of the lock of hair H to escape. For the sake of clarity, such ventilation apertures 22 are represented in a single row in FIG. 1A only, but may be configured in a variety of patterns and included in all of the various embodiments of the styling base described herein. The styling base 14A-14C may further include a plurality of outwardly extending prongs 24 to comb the lock of hair H. Similarly for the sake of clarity, such prongs 24 are represented in a single row in FIG. 1A only, but may be configured in a variety of patterns and included on all of the various embodiments of the styling base 14A-14C as described herein. An absorbent material 26 may be attached to, applied to, or impregnated in, a surface of the shield 16A-16G to absorb steam generated during heating of the lock of hair H. Such absorbent material 26 is represented in a strip-like form in FIG. 5A only, but may be configured in a variety of patterns and included on all of the various embodiments of the shield as described herein.

A temperature sensor 28 may be mounted to the styling base 14A-14C to detect the temperature of the lock of hair H (or the heat generated by the magnetron 12), and a moisture sensor 30 may be mounted to the styling base 14A-14C to detect the moisture content of the lock of hair H. Such sensors 28, 30 are represented in FIG. 3 only, and may be included in all of the various embodiments of the styling base as described herein. A controller 32 controls the operation of the magnetron 12. The controller 32 may include, among other things, a timer 34 and a microprocessor 35. The controller 32 and timer 34 are shown in FIG. 3, but may be included in all of the various embodiments of the hair styling device as described herein.

Figure 1B:
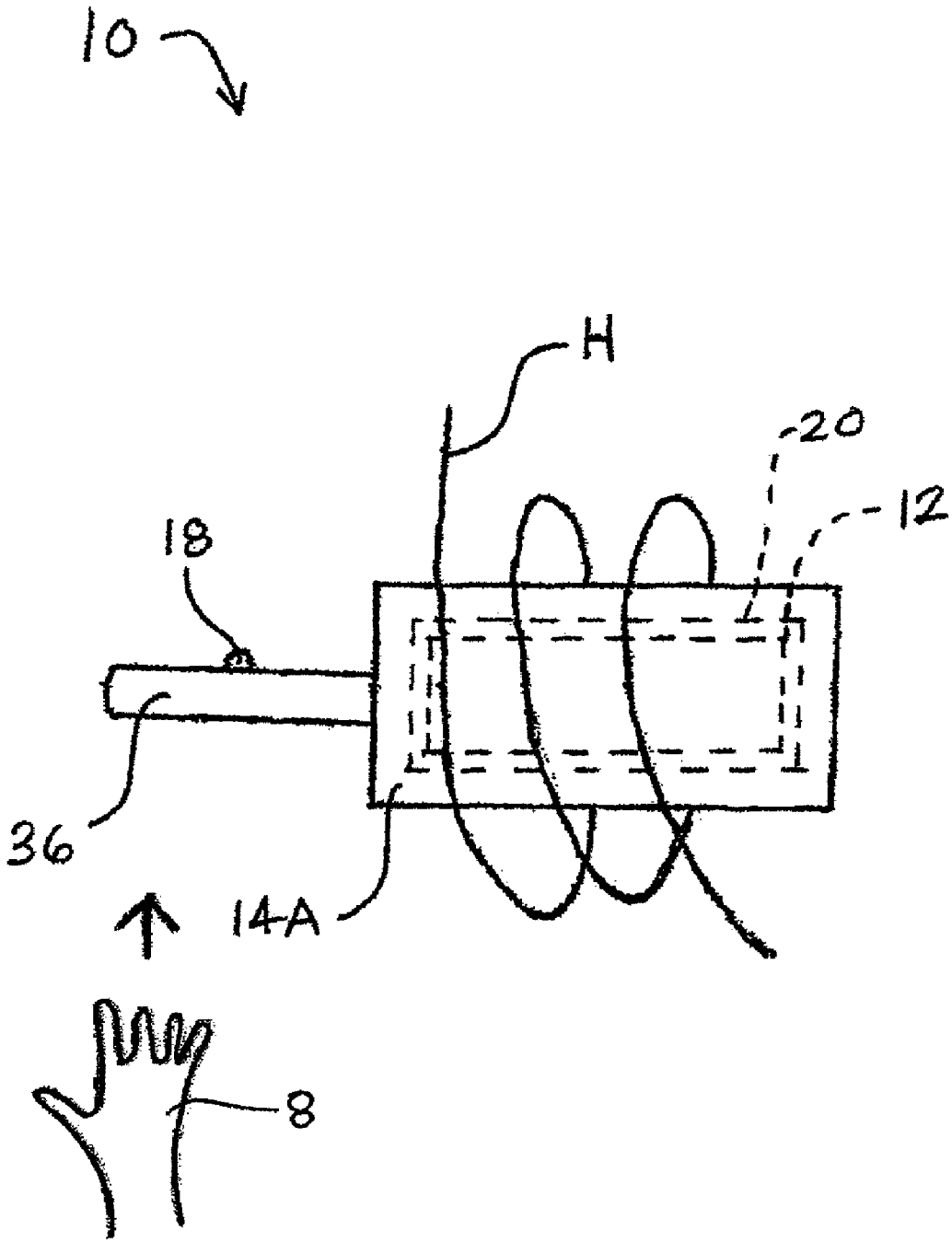
FIG. 1B represents a strand or lock of hair wrapped around the curling styling base of FIG. 1A.
Figure 1C:
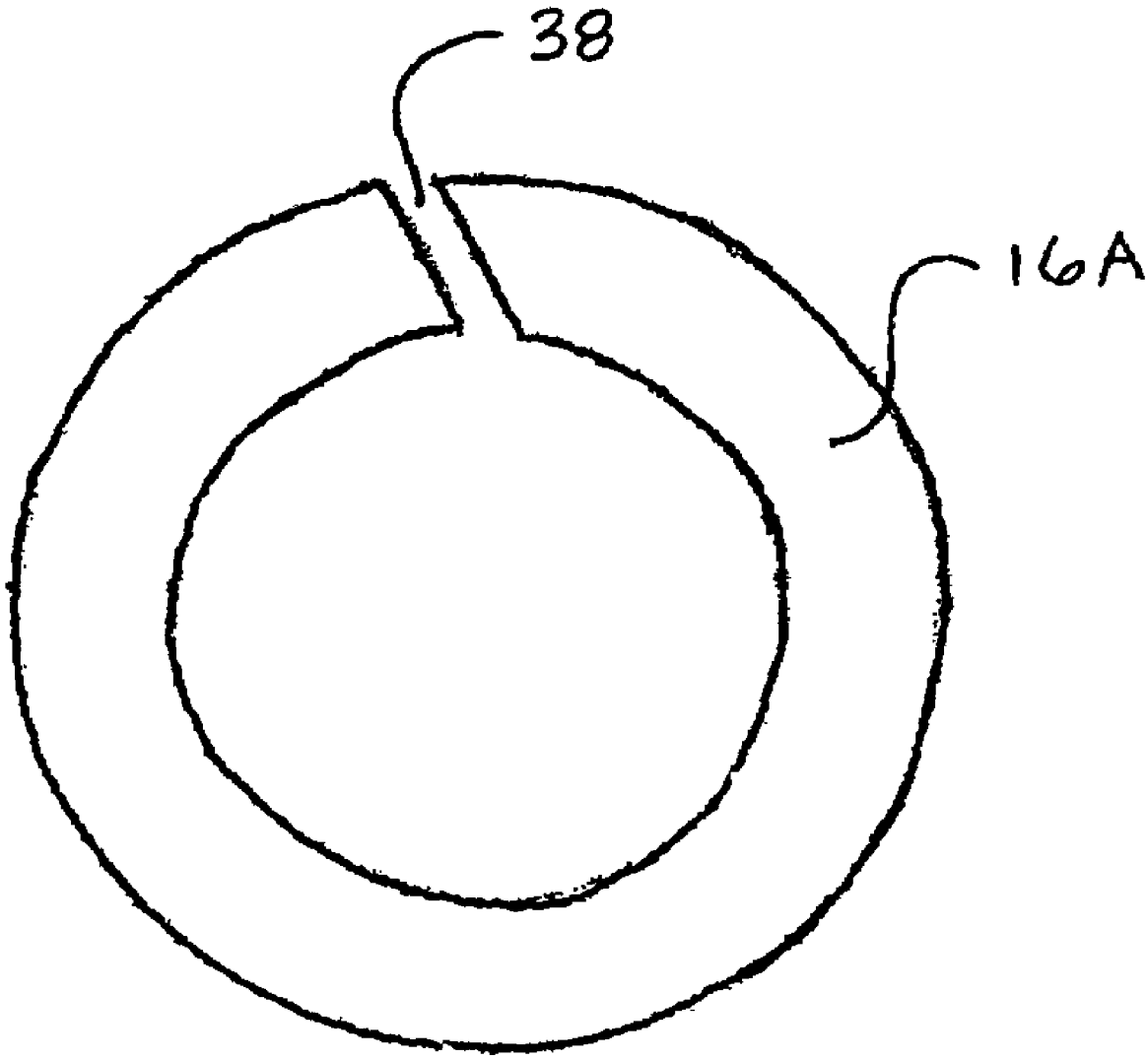
FIG. 1C is an end view of the shield of FIG. 1A.
Figure 1D:
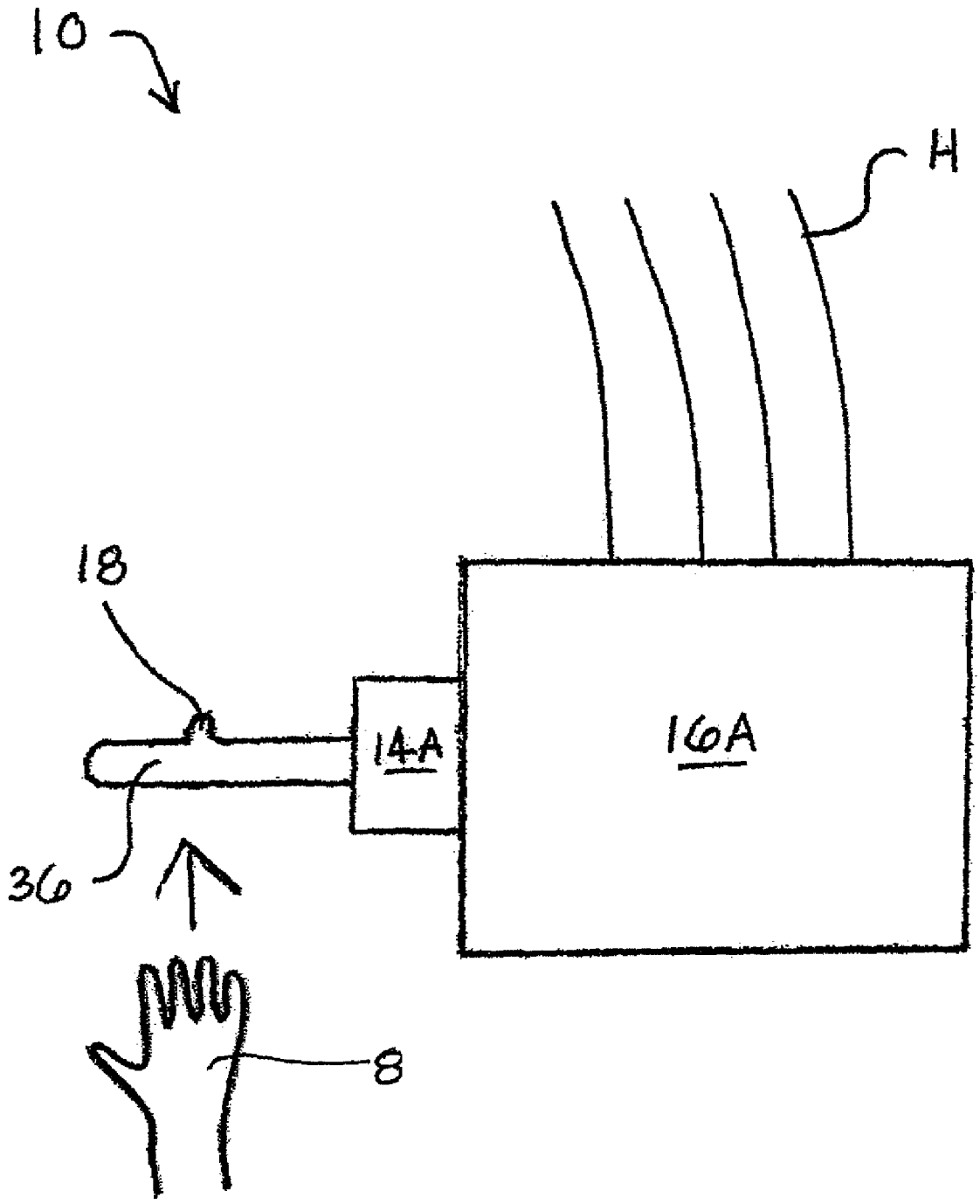
FIG. 1D represents an assembled hair styling device of FIG. 1A.

FIGS. 1A-1D show a hair styling device 10 wherein the styling base 14A is substantially cylindrical in shape for curling a lock of hair H, and the shield 16A is substantially cylindrical in shape for encasing the styling base 14A. A handle 36 may be provided, which can be held in the hand 8 of a user, to assist the user in holding, handling, and/or operating the device 10. FIG. 1A shows the shield 16A separate from the styling base 14A. FIG. 1B shows the lock of hair H wrapped around the styling base 14A. As shown in the end view of the shield 16A in FIG. 1C, the shield 16A includes a longitudinal slot 38. After the moistened lock of hair H has been wrapped around the styling base 14A (as represented in FIG. 1B), the shield 16A is slid over the hair H onto the styling base 14A with the slot 38 accommodating the portion of hair H extending between the scalp (not shown) and what is wrapped around the styling base 14A, as represented in FIG. 1D (this slot 38 is hidden from view in FIG. 1D).

Figure 2A:
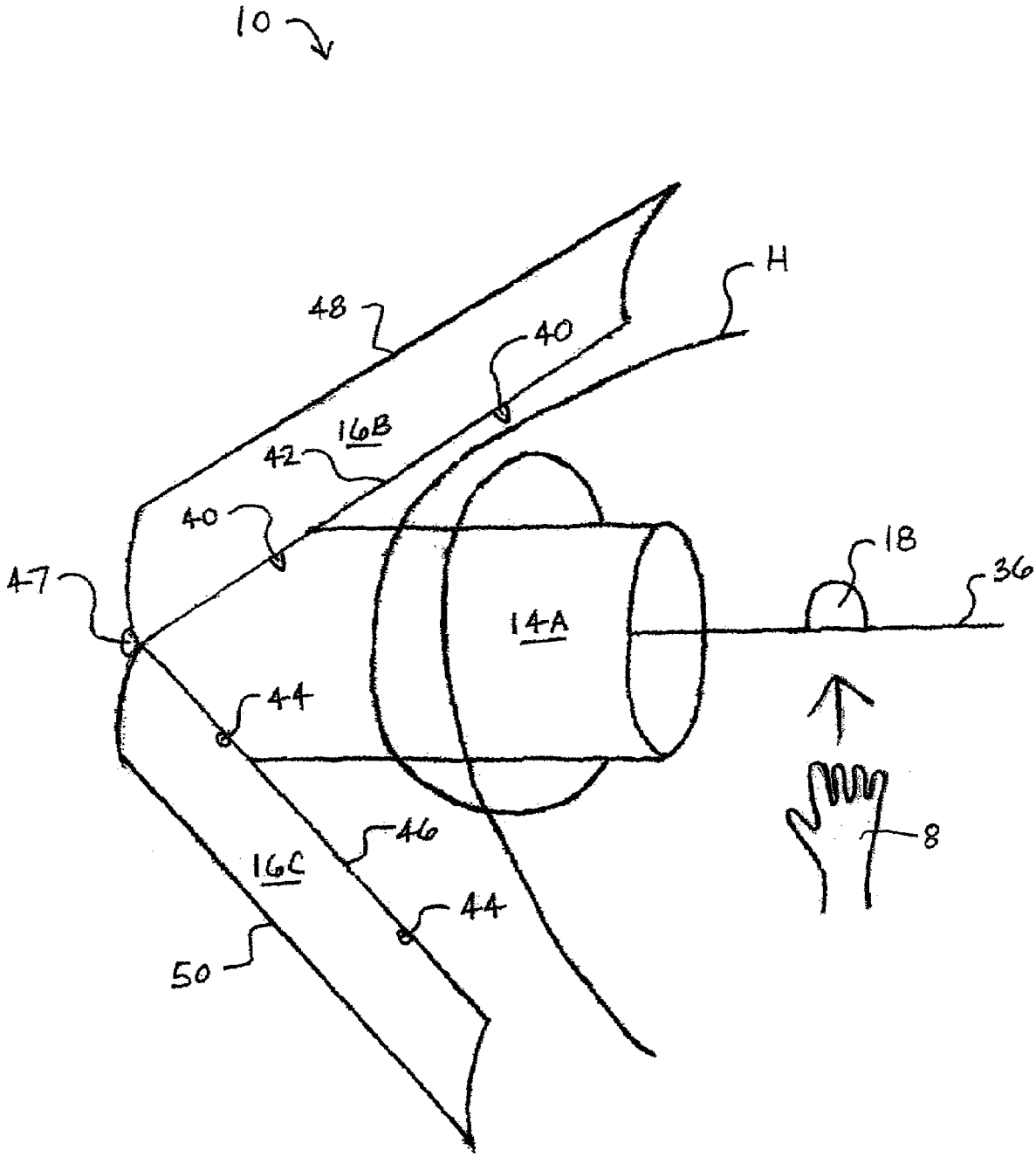
FIG. 2A represents another embodiment of a hair styling device showing a lock of hair wrapped around a curling styling base and an opened snap-on shield in accordance with the present invention.
Figure 2B:
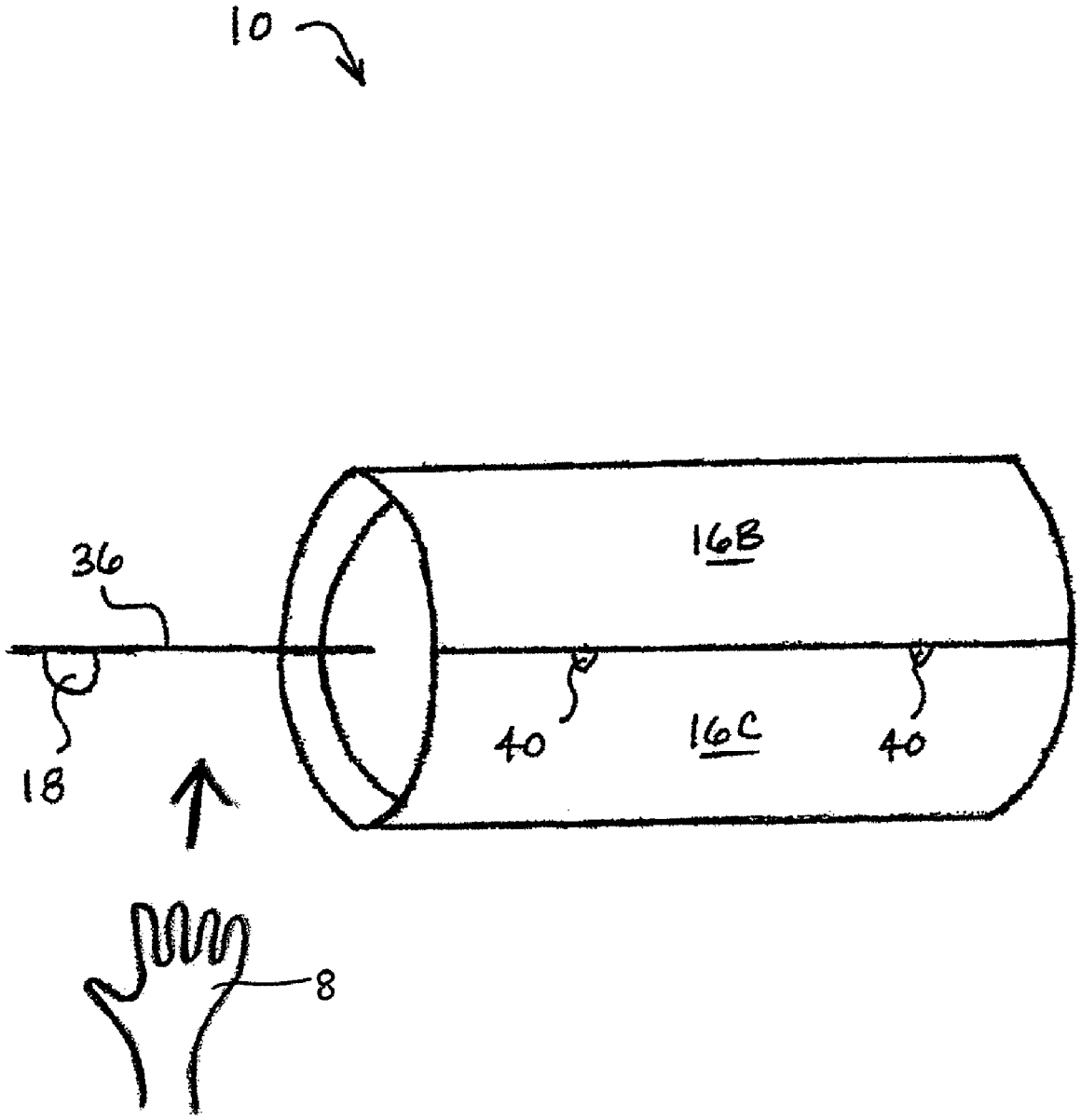
FIG. 2B represents the hair styling device of FIG. 2A showing the snap-on shield in a closed position.
Figure 3:
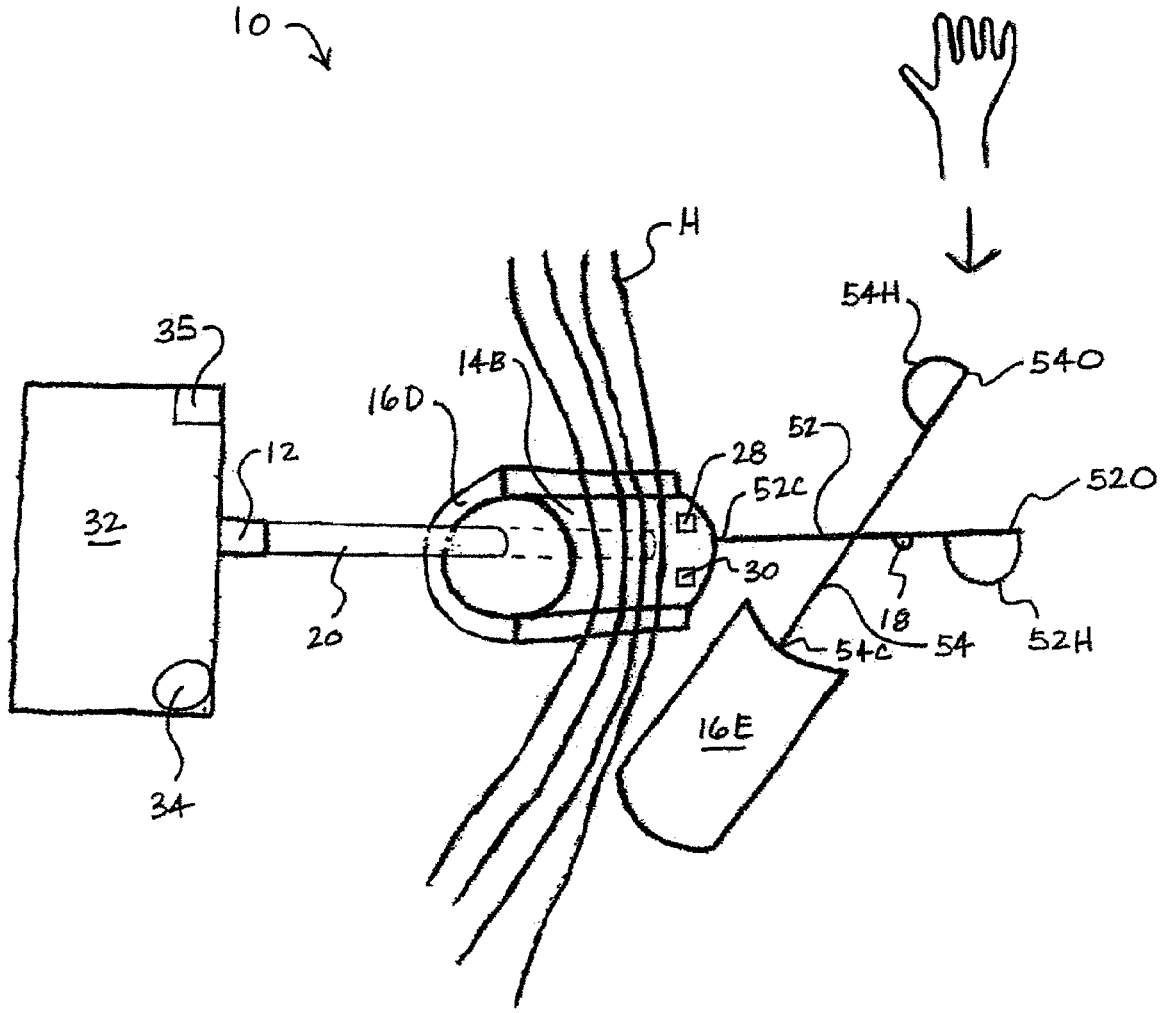
FIG. 3 represents a further embodiment of a hair styling device in an open scissor-like configuration showing a magnetron remotely connected to a curling styling base in accordance with the present invention.

In FIG. 2A, an alternative segmented shield 16B, 16C is represented. The segmented shield 16B, 16C may have protrusions 40 on an edge 42 of one of the segments 16B and corresponding apertures 44 on an edge 46 of the other segment 16C for receiving the protrusions 40. After a moistened lock of hair H has been wrapped around the styling base 14A, the segmented shield 16B, 16C is placed over the hair H onto the styling base 14A and the segments 16B, 16C are snapped together with the with the protrusions 40 snap-fitting into their respective apertures 44, as represented in FIG. 2B. Similar to the slot 38 described with reference to FIGS. 1C and 1D, when the segmented shield 16B, 16C is snapped together, an opening remains between the edges 48, 50 opposite the edges 42, 46 comprising the protrusions 40 and apertures 44 to accommodate the portion of hair H extending between the scalp and what is wrapped around the styling base 14A (this opening is hidden from view in FIG. 2B). The segments 16B, 16C may be joined at one end by a hinge 47.

In operation, the user wraps a lock of moistened hair H around the styling base 14A (as represented in FIGS. 1B and 2A). The prongs 24 extending outwardly from the styling base 14A (represented in FIG. 1A) assist in handling and/or holding the lock of hair H. As explained above, the shield 16A represented in FIG. 1C is slid over the hair H onto the styling base 14A, or the segmented shield 16B, 16C represented in FIG. 2A is placed over the hair H onto the styling base 14A and the segments 16B, 16C are snapped together. The user then operates the switch 18 to activate the magnetron 12 (represented in FIGS. 1A and 1B).

Microwave radiation (typically at a frequency range from 1,000 megahertz (MHz) to 300,000 MHz, corresponding to a wavelength range from 300 mm (about 12 in.) to 1 mm (about 0.04 in.)) is transmitted from the magnetron 12, guided and directed by the waveguide 20, through the styling base 14A, and to the wrapped lock of hair H. Water molecules in the moistened hair H absorb energy from the microwave beam in a process called dielectric heating. The positive charge at one end of each water molecule and the negative charge at the other end of each water molecule rotate as they try to align themselves with the alternating electric field induced by the microwave beam. This molecular movement creates heat as the rotating molecules hit other molecules and put them into motion. This heat dries and permanently sets the lock of hair H in a curled condition, or in another styled condition as selected by a user. The ventilation apertures 22 (represented in FIG. 1A) allow steam generated during heating of the lock of hair H to escape. Similarly, the absorbent material 26 (represented in FIG. 5A) attached to a surface of the shield 16A-16C absorbs steam generated during heating of the lock of hair H to protect the user's skin (not shown) from burning or scalding.

After a predetermined duration, the user operates the switch 18 to deactivate the magnetron 12. A user will then remove the shield 16A-16C, and release the lock of hair H from the styling base 14A. As explained above, temperature and control sensors 28, 30 (represented in FIG. 3) communicate with a controller 32 (represented in FIG. 3) which controls the operation of the magnetron 12 to avoid overheating of the hair H.

Figure 4A:
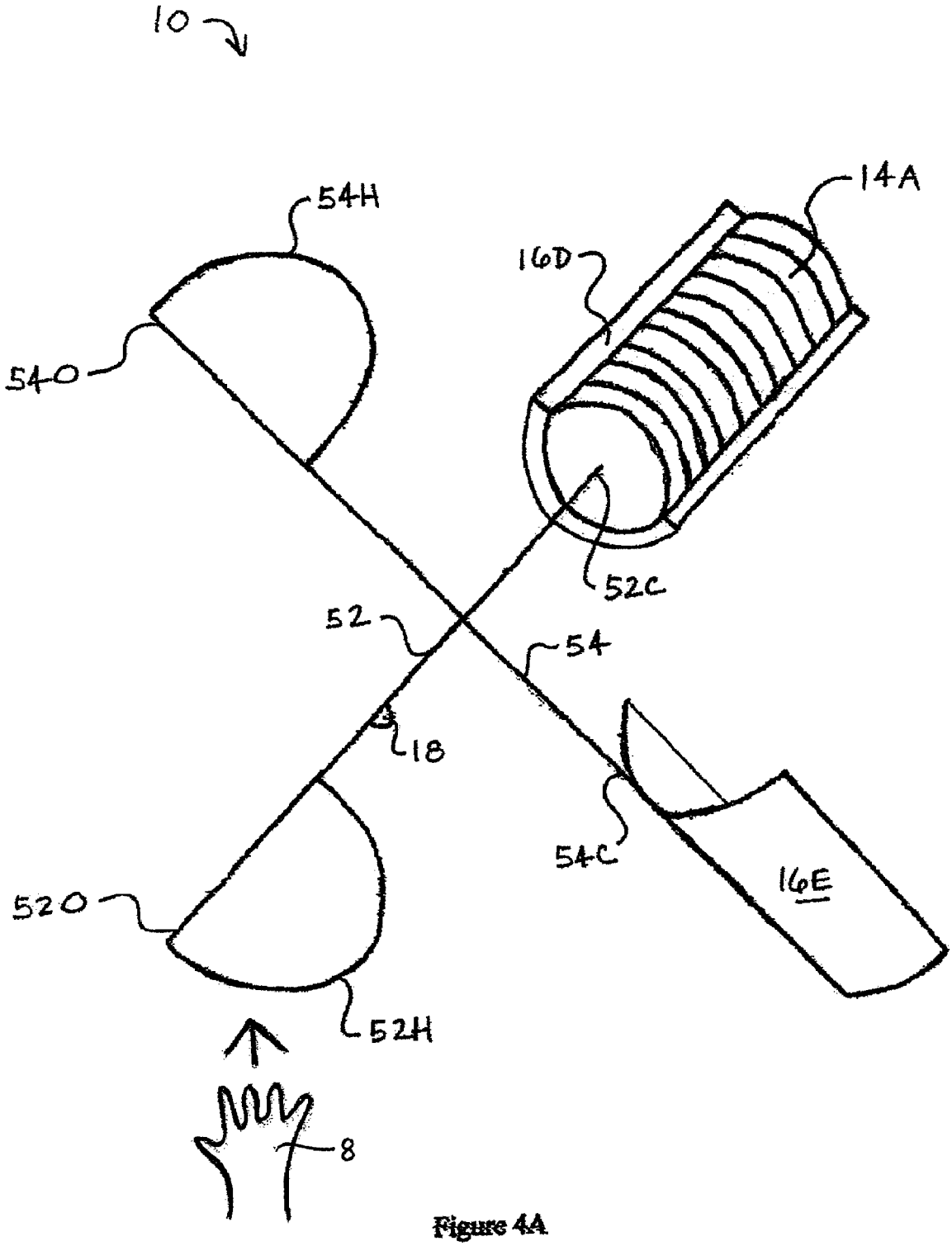
FIG. 4A represents another embodiment of the hair styling device of FIG. 3 showing a magnetron disposed within the curling styling base in accordance with the present invention.
Figure 4B:
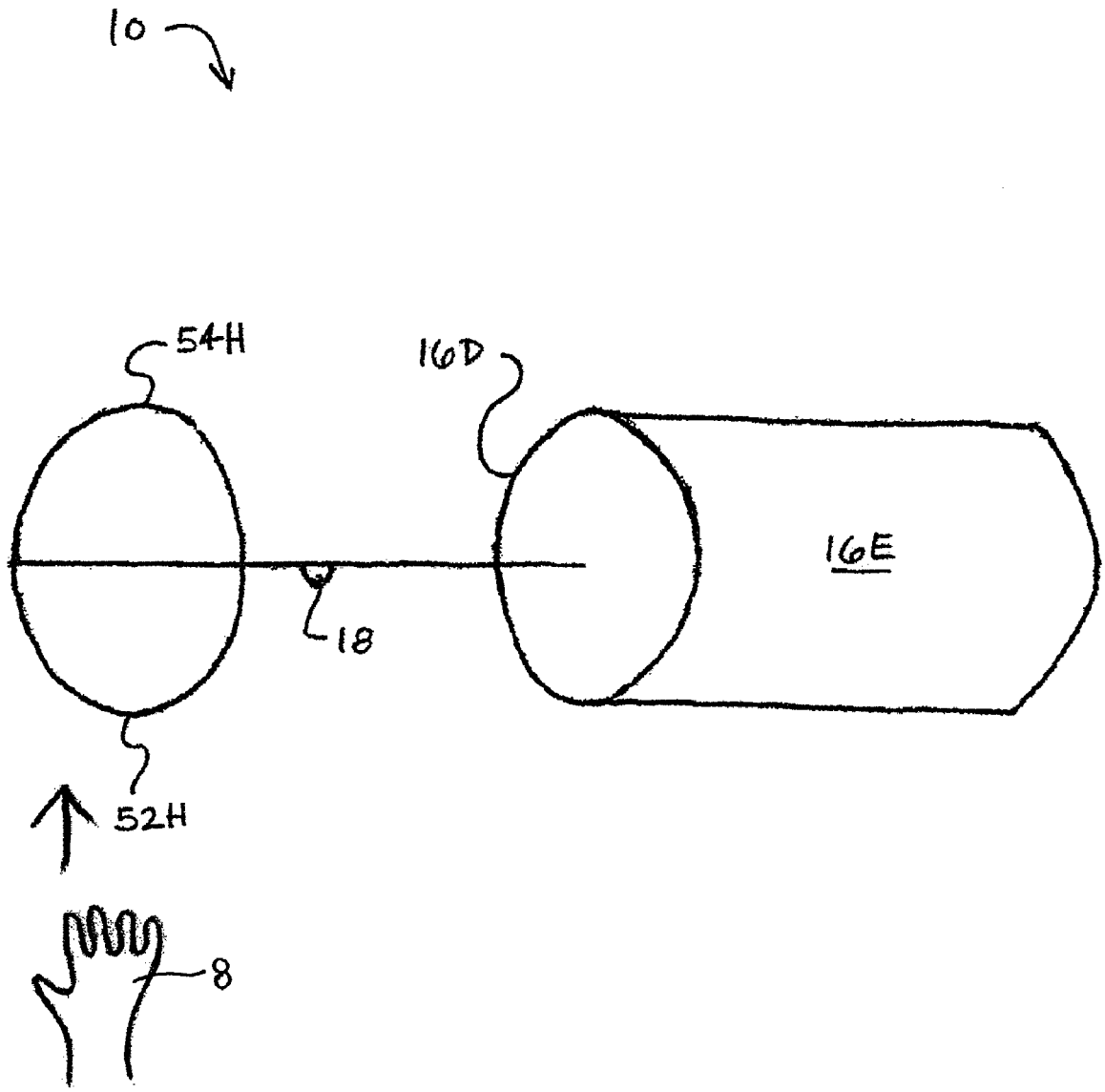
FIG. 4B represents the hair styling device of FIG. 4A in a clamped configuration.
Figure 4C:
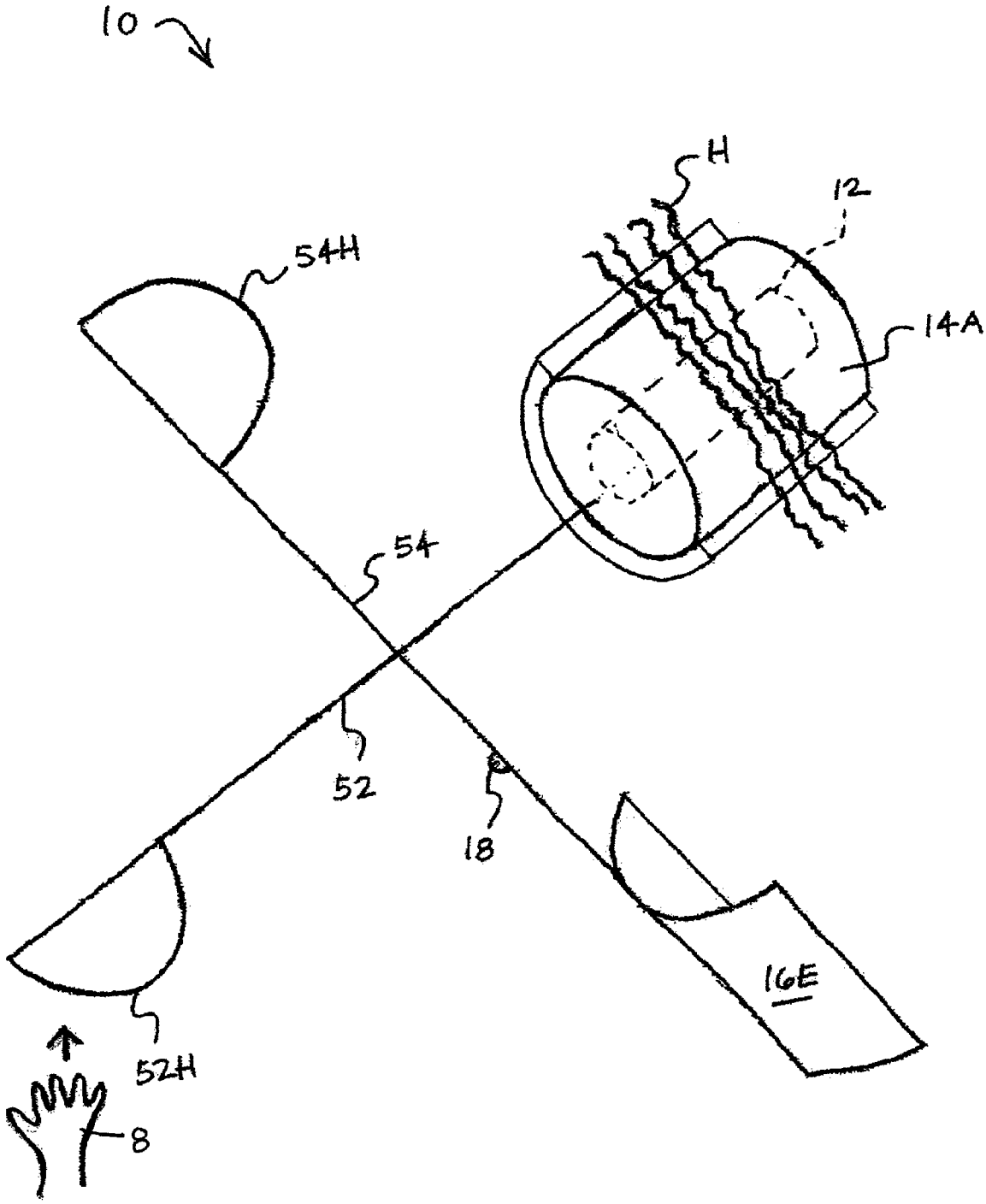
FIG. 4C represents the hair styling device of FIG. 4A showing a lock of kinky hair on the curling styling base.

FIGS. 3 and 4A-4D show a styling base member 52 and a clamping member 54 pivotally connected (such as by a hinge) to each other in a scissor-like configuration. As explained above, FIG. 3 represents a magnetron 12 remotely connected to the styling base 14B through a waveguide 20. FIGS. 4A-4D includes a magnetron 12 disposed within the styling base 14A (as represented in FIG. 4C). Each of the members 52, 54 includes a clamping end 52C, 54C and an operating end 52O, 54O. The shield 16D, 16E includes a styling base portion 16D connected to an outer surface of the styling base 14A, 14B, and a clamping portion 16E. The styling base 14A, 14B is disposed on the clamping end 52C of the styling base member 52 and the clamping portion 16E of the shield 16D, 16E is disposed on the clamping end 54C of the clamping member 54. The operating end 52O, 54O of each member 52, 54 includes a handle 52H, 54H configured to receive a user's thumb (not shown) through one of the handles 52H, 54H and a finger or fingers (not shown) through the other of the handles 52H, 54H.

Figure 4D:
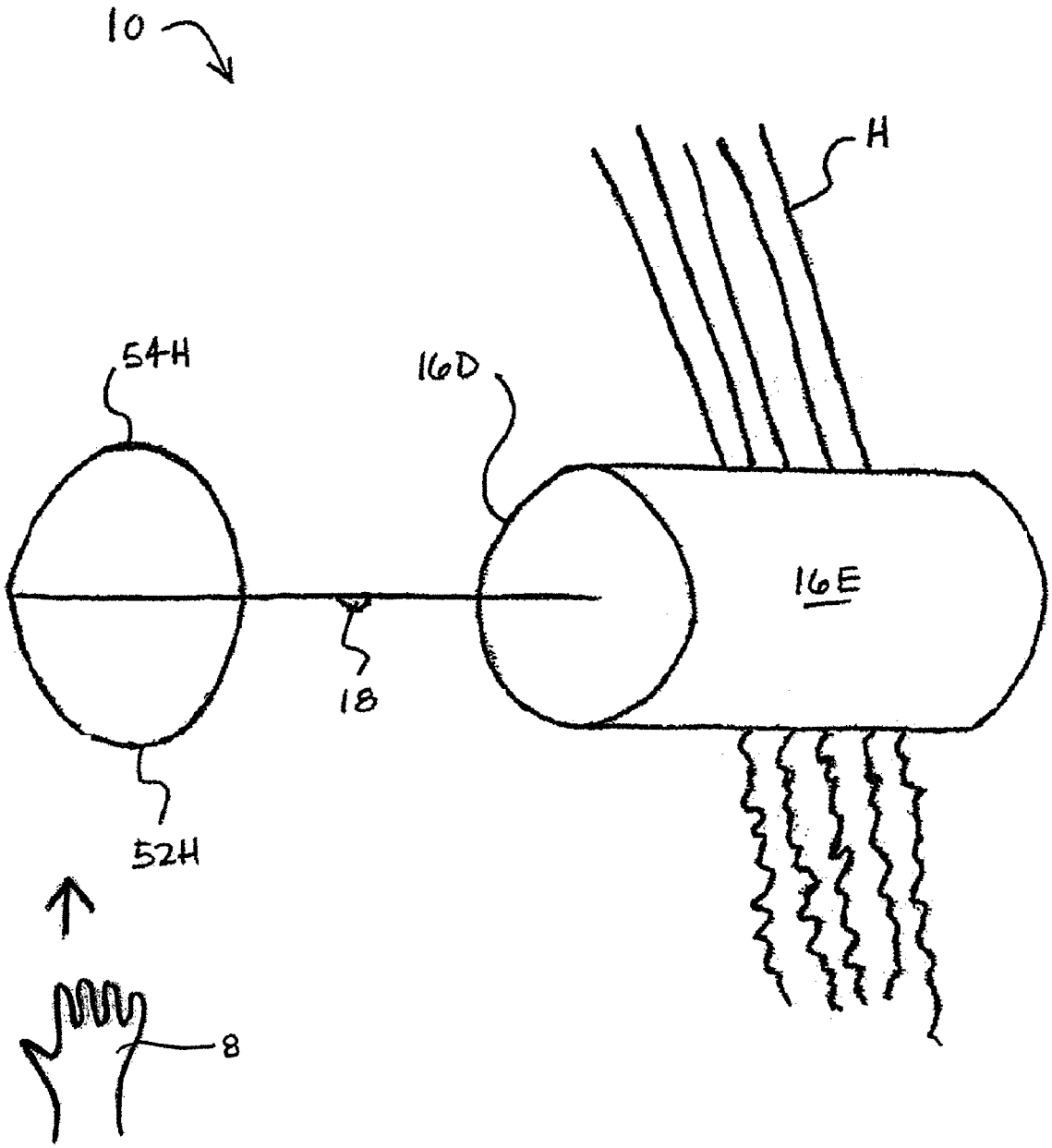
FIG. 4D represents the hair styling device of FIG. 4A showing a lock of kinky hair being smoothened and curled.
Figure 5A:
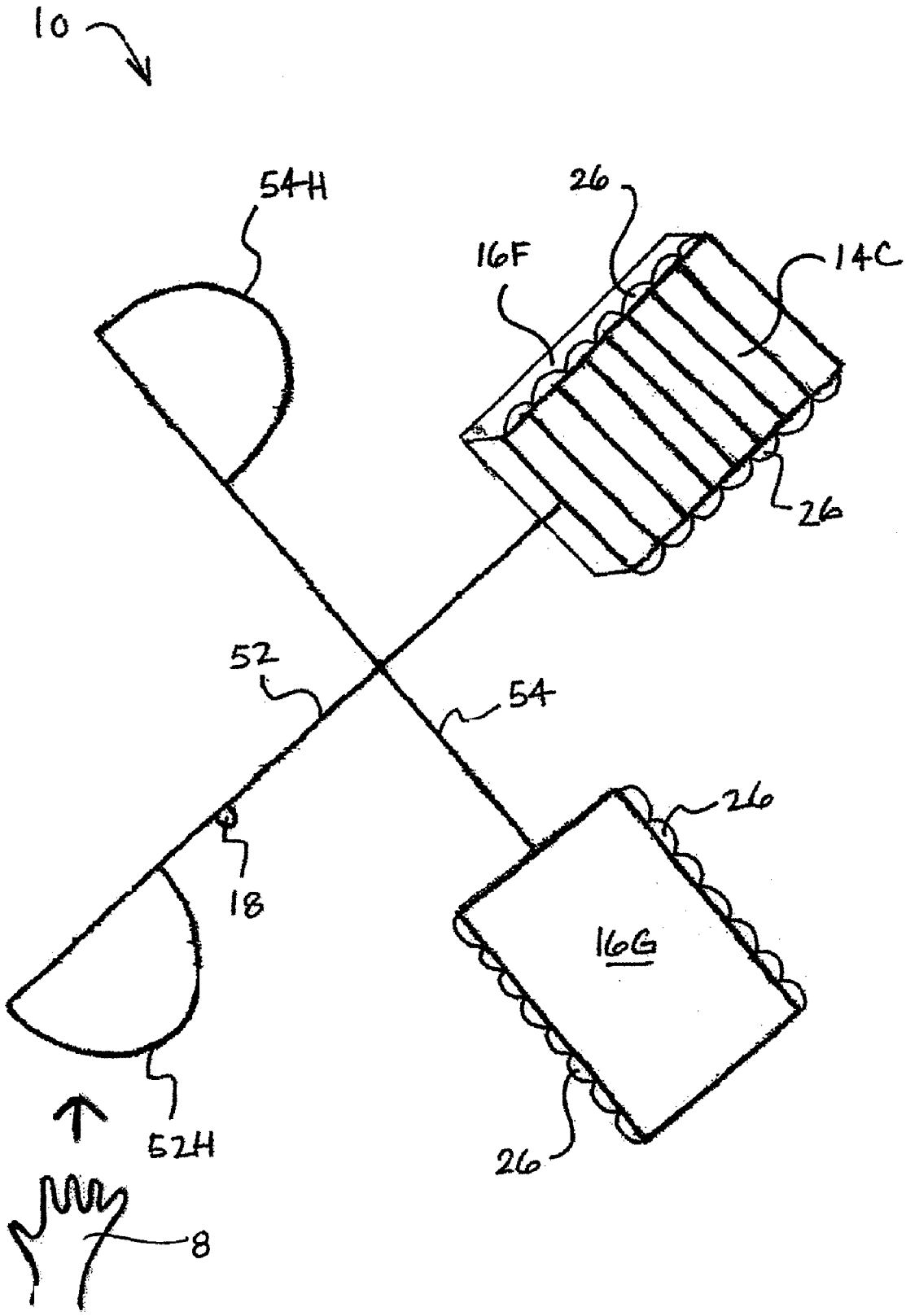
FIG. 5A represents a further embodiment of the hair styling device of FIG. 4A showing a flat styling base in accordance with the present invention.
Figure 5B:
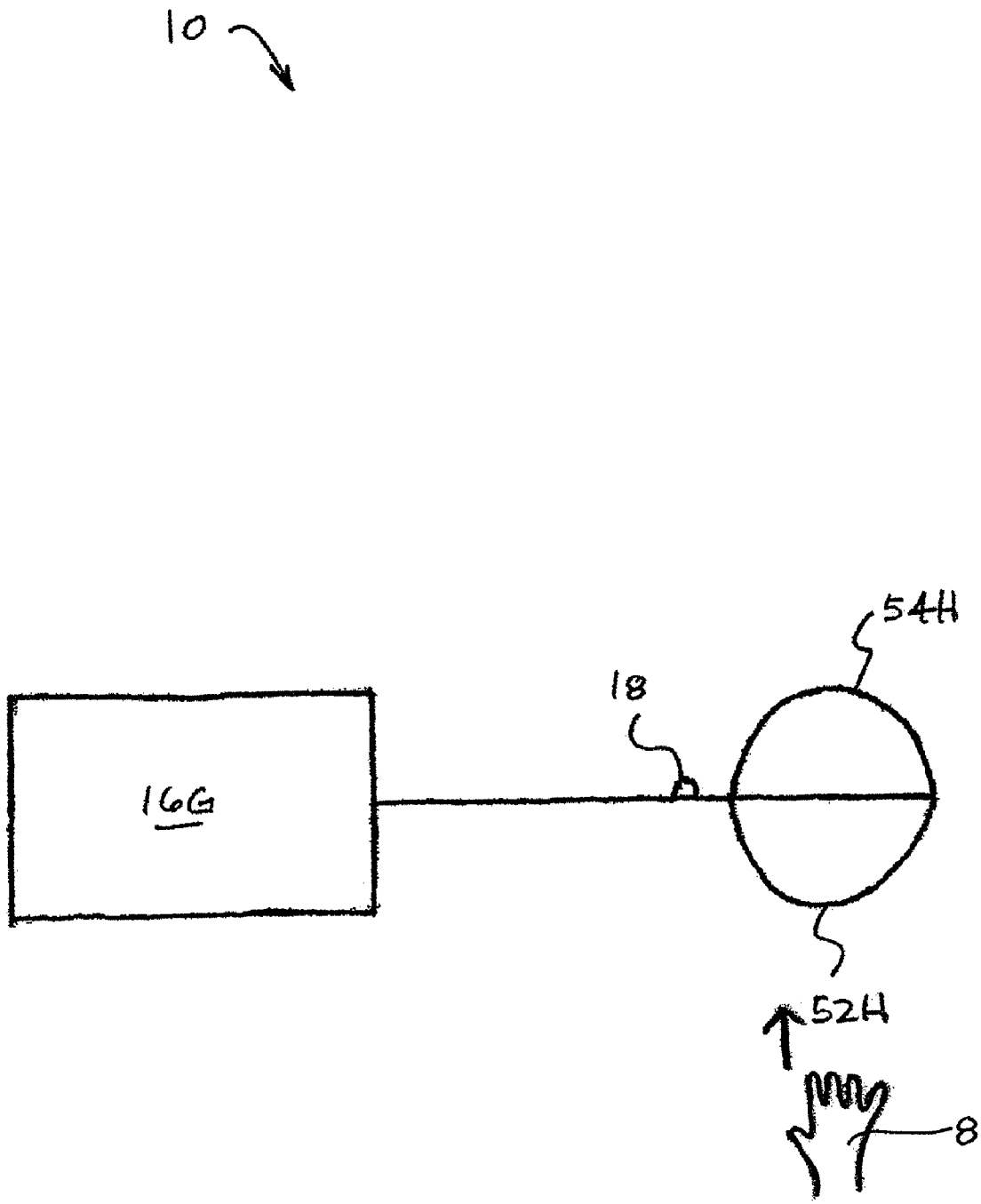
FIG. 5B represents the hair styling device of FIG. 5A in a clamped configuration.
Figure 5C:
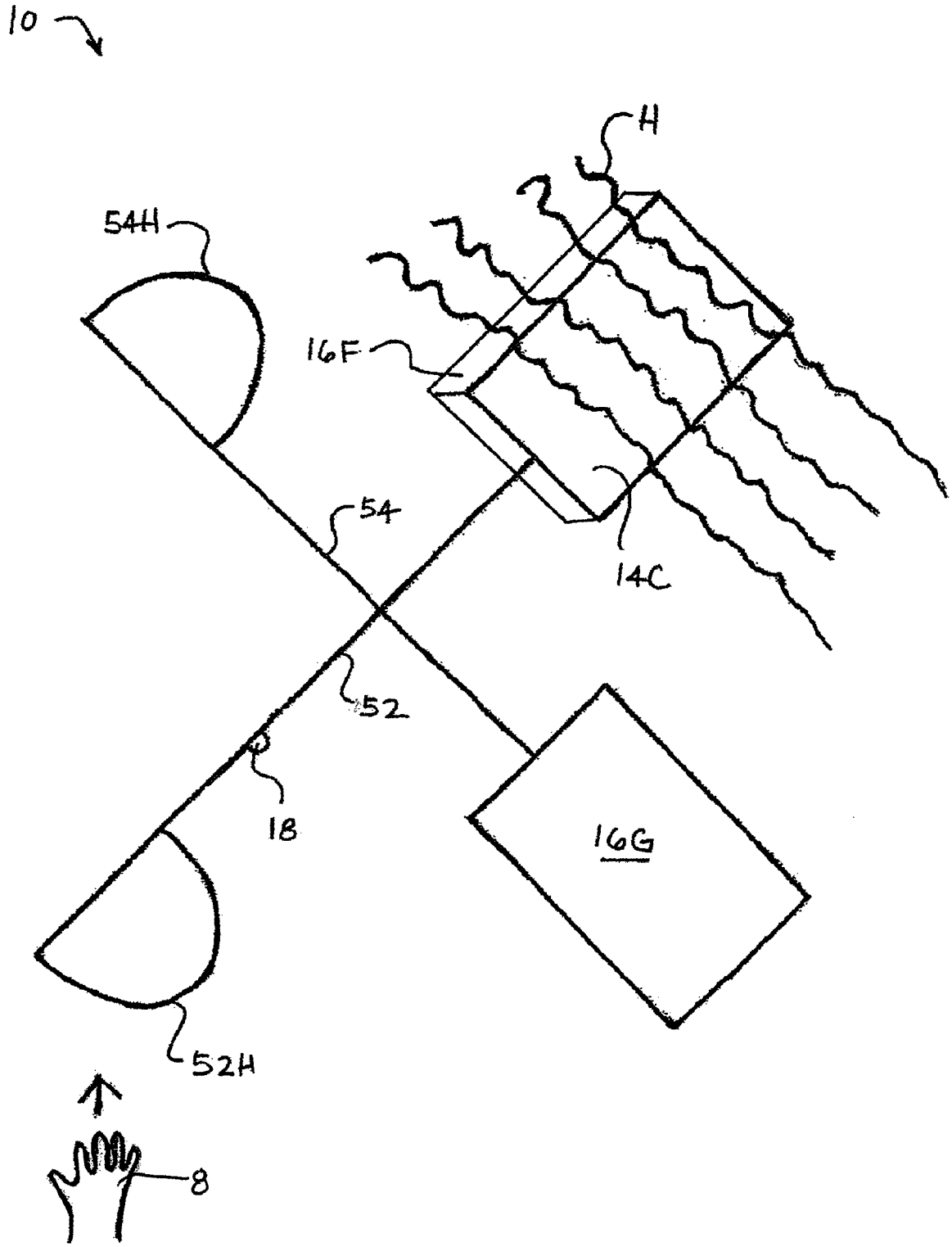
FIG. 5C represents the hair styling device of FIG. 5A showing a lock of kinky hair on the flat styling base.
Figure 5D:
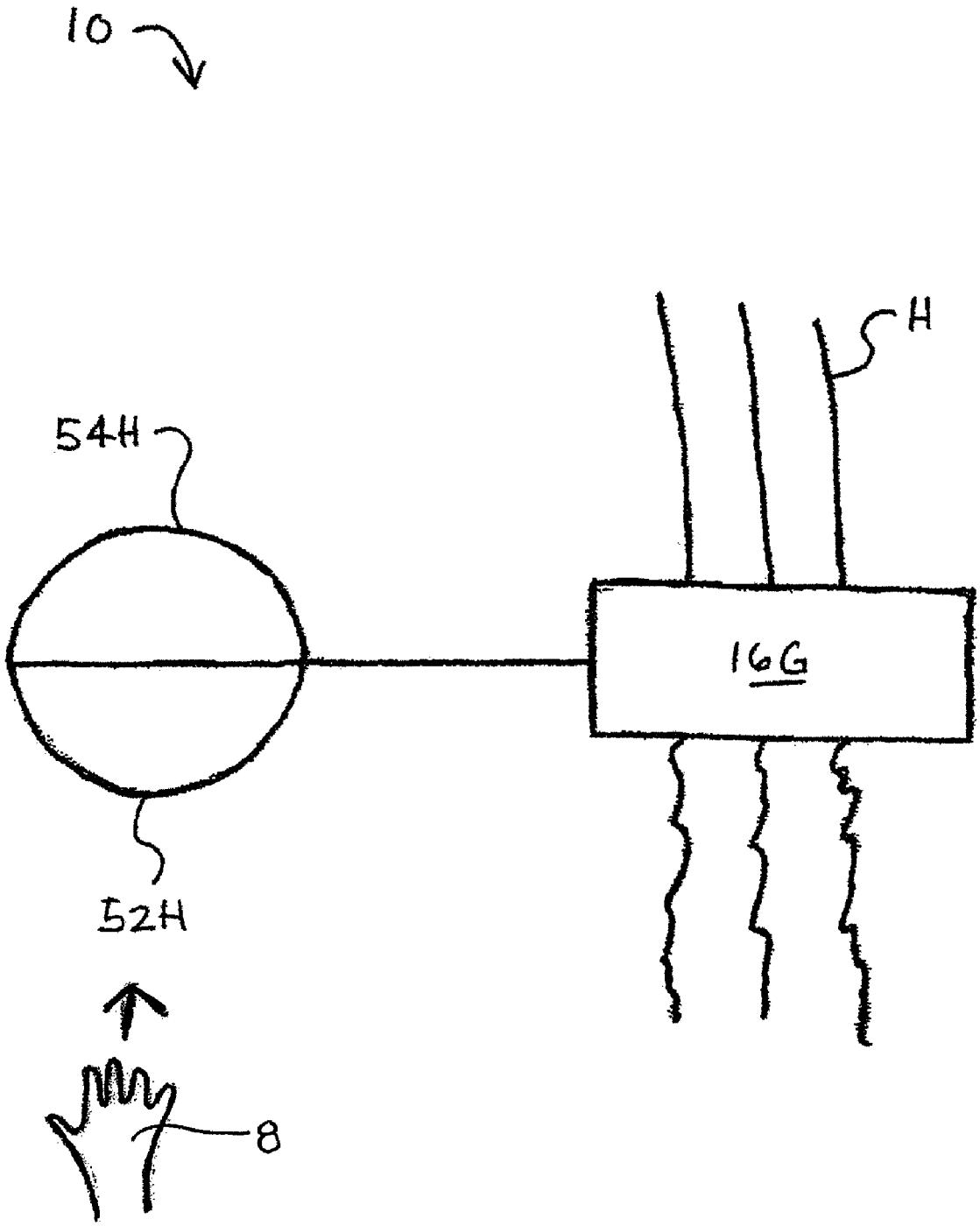
FIG. 5D represents the hair styling device of FIG. 5A showing a lock of kinky hair being straightened.

Movement of the operating ends 52O, 54O of the respective members 52, 54 towards each other causes the styling base 14A, 14B and the clamping portion 16E of the shield 16D, 16E to move towards each other (as represented in FIGS. 4B and 4D), and movement of the operating ends 52O, 54O of the respective members 52, 54 away from each other causes the styling base 14A, 14B and the clamping portion 16E of the shield 16D, 16E to move away from each other (as represented in FIGS. 3, 4A, and 4C). After a moistened lock of hair H is placed on the styling base 14A, 14B as shown in FIGS. 3 and 4C, the user moves the operating ends 52O, 54O of the styling base member 52 and a clamping member 54 towards each other, causing the styling base 14A, 14B and the clamping portion 16E of the shield 16D, 16E to clamp the lock of hair H, as shown in FIG. 4D.

The operation of the magnetron 12 of the hair styling device 10 represented in FIGS. 3 and 4A-4D is virtually identical to that described above with reference to FIGS. 1A-2B except that, where the magnetron 12 is remotely connected to the styling base 14B (as represented in FIG. 3), the microwave radiation is passed from the magnetron 12, guided and directed by the waveguide 20, and then through the styling base 14B and the wrapped lock of hair H. Similarly, the ventilation apertures 22 (represented in FIG. 1A), the prongs 24 (represented in FIG. 1A), and the absorbent material 26 (represented in FIG. 5A) function in the same ways as described above with reference to FIGS. 1A-2B.

The clamping force between the styling base 14A, 14B and the clamping portion 16E of the shield 16D, 16E permits movement along the length of the lock of hair H. More specifically, the hair styling device 10 can be slid down along the length of the lock of hair H when the device 10 is in its clamped position to style the entire length of the lock in one smooth motion (rather than having to style discrete segments along the same lock of hair H one at a time). After the desired duration, the user operates the switch 18 to deactive the magnetron 12 and moves the operating ends 52O, 54O of the styling base member 52 and the clamping member 54 away from each other. This movement causes the styling base 14A, 14B and the clamping portion 16E of the shield 16D, 16E to release the lock of hair H which has been dried and permanently set in a slightly curled and smoothed condition by the microwave radiation from the magnetron 12.

The configuration and operation of the hair styling device 10 represented in FIGS. 5A-5D is virtually identical to that described above with reference to FIGS. 3 and 4A-4D, except that the styling base 14C is substantially flat in shape for straightening a lock of hair H. Similarly, the shield 16F, 16G is substantially flat in shape and includes a styling base portion 16F connected to an outer surface of the styling base 14C, and a clamping portion 16G.

While the preferred embodiments of the invention have been described in detail above, the invention is not limited to the specific embodiments described which should be considered as merely exemplary. Further modifications and extensions of the present invention may be developed and all such modifications are deemed to be within the scope of the present invention as defined by the appended claims.

What is claimed is:

1. A hair styling apparatus comprising:

a magnetron;

a substantially cylindrical hand held styling base in communication with the magnetron for styling a moistened lock of hair; and a substantially cylindrical shield including a longitudinal slot removably encasing the styling base for shielding microwave radiation emitted from the magnetron;

wherein the lock of hair is heated upon activation of the magnetron.

2. The hair styling device of claim 1, wherein the magnetron is disposed within the styling base.

3. The hair styling device of claim 1, wherein the magnetron is remotely connected to the styling base.

4. The hair styling apparatus of claim 1, wherein the styling base comprises a plurality of ventilation apertures to allow steam generated during heating of the lock of hair to escape.

5. The hair styling apparatus of claim 1, wherein the styling base comprises a plurality of outwardly extending prongs to comb the lock of hair.

6. The hair styling apparatus of claim 1, wherein the shield comprises a combination of glass material and conductive mesh material.

7. The hair styling apparatus of claim 1, further comprising an absorbent material attached to a surface of the shield to absorb steam generated during heating of the lock of hair.

8. The hair styling apparatus of claim 1, further comprising:

a temperature sensor that detects the temperature of the lock of hair; and a moisture sensor that detects the moisture content of the lock of hair.

9. The hair styling apparatus of claim 8, further comprising a controller that controls an operation of the magnetron.

10. The hair styling apparatus of claim 9, wherein the controller comprises a timer.

11. A hair styling apparatus comprising:

a magnetron;

a substantially cylindrical hand held styling base in communication with the magnetron for styling a moistened lock of hair; and a substantially cylindrical shield comprising two longitudinal segments that snap-fit together to removably encase the styling base for shielding microwave radiation emitted from the magnetron;

wherein the lock of hair is heated upon activation of the magnetron.

12. A hair styling apparatus comprising:

a magnetron;

a hand held styling base in communication with the magnetron for styling a moistened lock of hair;

a shield comprising a styling base portion connected to an outer surface of the styling base, and a clamping portion, the shield removably encasing the styling base for shielding microwave radiation emitted from the magnetron;

a styling base member; and a clamping member;

each of the members comprising a clamping end, and an operating end;

wherein the lock of hair is heated upon activation of the magnetron; and wherein the styling base is disposed on the clamping end of the styling base member and the clamping portion of the shield is disposed on the clamping end of the clamping member.

13. The hair styling apparatus of claim 12, wherein the styling base member and the clamping member are pivotally connected to each other.

14. The hair styling apparatus of claim 12, wherein the styling base member and the clamping member are pivotally connected to each other in a scissor-like configuration, movement of the operating ends of the respective members towards each other causes the styling base and the clamping portion of the shield to move towards each other, and movement of the operating ends of the respective members away from each other causes the styling base and the clamping portion of the shield to move away from each other.

* * * * *